US005349976A

United States Patent [19]

Ko

[11] Patent Number: 5,349,976

[45] Date of Patent: Sep. 27, 1994

[54] STRUCTURE OF UMBRELLA RING

[76] Inventor: Fu Y. Ko, No. 7, Lane 30, Chung Shiao Street, Changhua, Taiwan

[21] Appl. No.: 130,274

[22] Filed: Oct. 1, 1993

[51] Int. Cl.[5] ..... A45B 19/00

[52] U.S. Cl. ..... 135/25.4; 135/44

[58] Field of Search ..... 135/44, 25.4, 37, 24, 135/15.1; 362/399; 280/821

[56] References Cited

U.S. PATENT DOCUMENTS

| | | | |
|---|---|---|---|
| 688,627 | 12/1901 | Fry | 135/44 |
| 766,678 | 8/1904 | Ekman et al. | 135/44 |
| 955,255 | 4/1910 | Dilli | 135/44 |
| 963,753 | 7/1910 | Durand | 135/44 |
| 995,124 | 6/1911 | Finerty | 135/44 X |
| 1,073,631 | 9/1913 | Revel | 135/44 |
| 5,048,152 | 9/1991 | Gray | 135/44 X |
| 5,125,426 | 6/1992 | Wu et al. | 135/44 X |

*Primary Examiner*—Carl D. Friedman
*Assistant Examiner*—Lan C. Mai
*Attorney, Agent, or Firm*—Merchant, Gould, Smith, Edell, Welter & Schmidt

[57] ABSTRACT

An umbrella ring which is used to position the tips which connect every corner of the canopy to the ribs of the umbrella which can not be telescoped and mainly consisting of a shank, a canopy, ribs, tips and a handle. The improved ring brings all the ribs together and has a sleeve wherein one or more slots are formed for positioning the tips which connect the canopy to the ribs so that the umbrella ring can slide along the shank to an appropriate position to place the ribs and the tips completely in the inner space of the umbrella ring effectively and easily.

4 Claims, 5 Drawing Sheets

FIG.1-A

STRUCTURE OF UMBRELLA RING

BACKGROUND OF THE INVENTION

The present invention relates to an improved structure of an umbrella ring which would eliminate the drawbacks of existing umbrella rings used in traditional large umbrellas, and more particularly to a plastic umbrella ring which could stretch the umbrella ribs effectively and position the plastic tips which connect every corner of the canopy to the ribs in one or more slots installed in the rim so that the umbrella can be closed effectively.

Referring to FIG. 1, a prior art umbrella is shown in which the shank 2 can not be telescoped, and every corner of the canopy 3 is connected with an end of an umbrella rib 4 by plastic tips 5 instead of by sewing. Referring to FIGS. 1, 1 A, 2 and 3, the umbrella mainly consists of a shank 2, a canopy 3, ribs 4, tips 5 and a handle 6. A position point 21 is installed in the lower part of the shank 2. A sleeve 61 is fitted over the lower part of the shank 2 and abuts the position point 21. A handle 6 is fitted over the sleeve 61. A metal sliding ring 7 with a hole 71 formed in the center freely slides over the portion of the sleeve 61 exposed between an end of the handle 6 and the position point 21. The sliding ring 7 is limited to slide on the sleeve 61 between position point 21 and the handle 6 so that when the umbrella is closed, all the ribs 4 can be located in a cupped inner space 72 of the sliding ring 7.

Although the sliding ring 7 can position all the ribs 4, it is made of metal and can not position the plastic tips 5 effectively inside the sliding ring 7. Moreover, after the umbrella has been repeatedly used, the position point 21 might inadvertently be removed from the shank which would allow the sliding ring 7 to slide along the entire shank 2.

Referring to FIGS. 1 and 3, to eliminate the aforesaid disadvantages of the metal sliding ring 7, an elastic element unit 8, such as a spring, is installed under the sliding ring for supporting the sliding ring 7 and to aid in positioning the ribs 4 inside the ring effectively. However, if the position point 21 is removed from the shank 2, unlimited sliding of the sliding ring 7 would still happen.

Therefore, in view of the above-mentioned drawbacks, the inventor of the present invention has developed an improved umbrella ring.

SUMMARY OF THE INVENTION

It is therefore a main object of the present invention to provide an improved structure of an umbrella ring for effectively retaining umbrella tips proximate an umbrella shaft, the umbrella ring comprising a cup having an annular peripheral wall extending from a circular base, the circular base having a central aperture adapted to receive the umbrella shaft; a sleeve anchored coaxially with the central aperture to the circular base; the sleeve having a plurality of slots formed therein and defining a plurality of cantilever spring fingers extending along the umbrella shaft; and whereby the cup is deflectable from a first position in which the cup is normally retained in axial alignment with the shaft by the spring fingers to a second position in which the cup is tipped out of axial alignment with the shaft to facilitate placement of the umbrella tips into the cup or removal of the umbrella tips from the cup, the cup being restored to the first position by the spring fingers.

It is another object of the present invention to provide an improved umbrella ring which is made of plastic so that the elasticity can maintain the convenience of sliding the ring on said shank.

It is a further object of the present invention to provide an improved umbrella ring with great elasticity to facilitate placing the umbrella tips inside the ring.

BRIEF DESCRIPTION OF THE DRAWINGS

FIG. 1 A is a detail of the connection of a corner of the canopy and an umbrella rib;

DETAILED DESCRIPTION OF THE PREFERRED EMBODIMENTS

Figure 1:
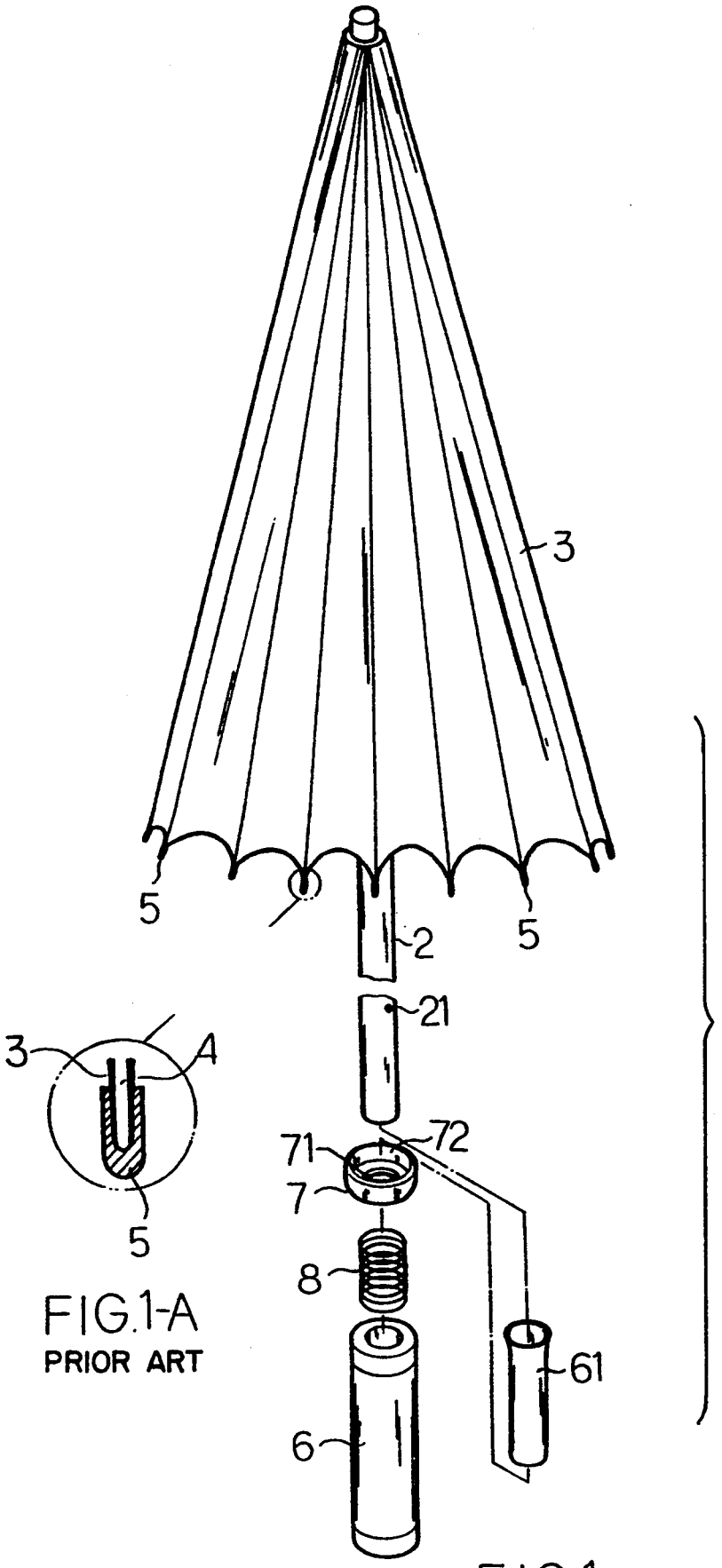
PRIOR ART FIG.1 PRIOR ART
FIG. 1 is an exploded view of the prior structure.
Figure 2:
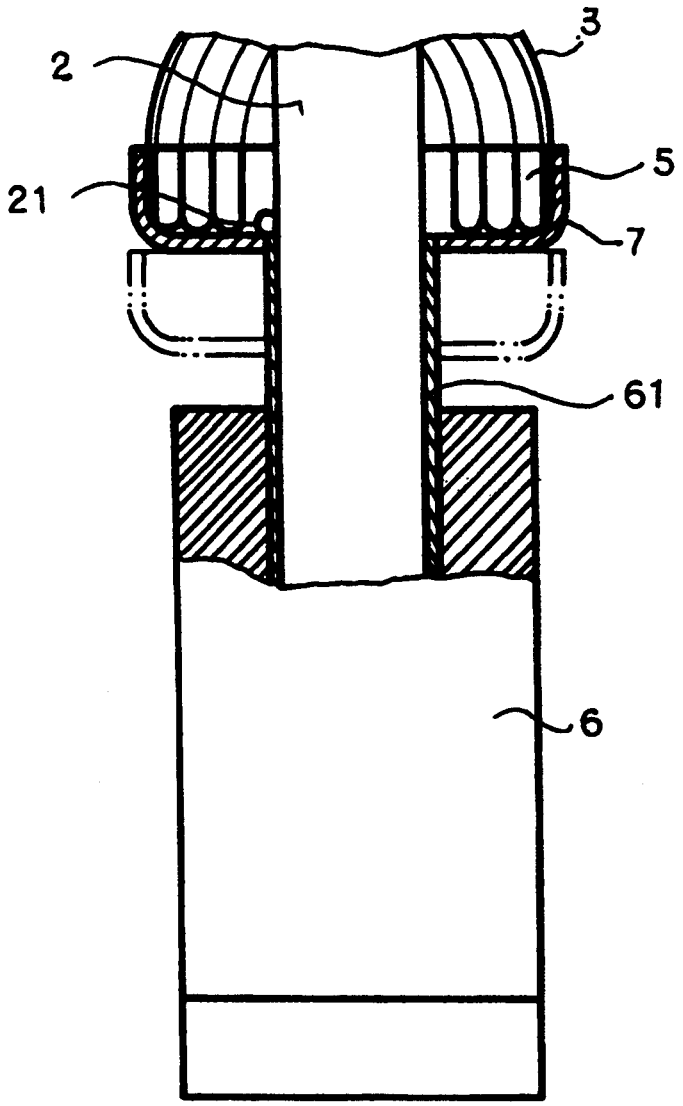
FIG. 2 PRIOR ART
FIG. 2 is a sectional view of the prior structure.
Figure 3:
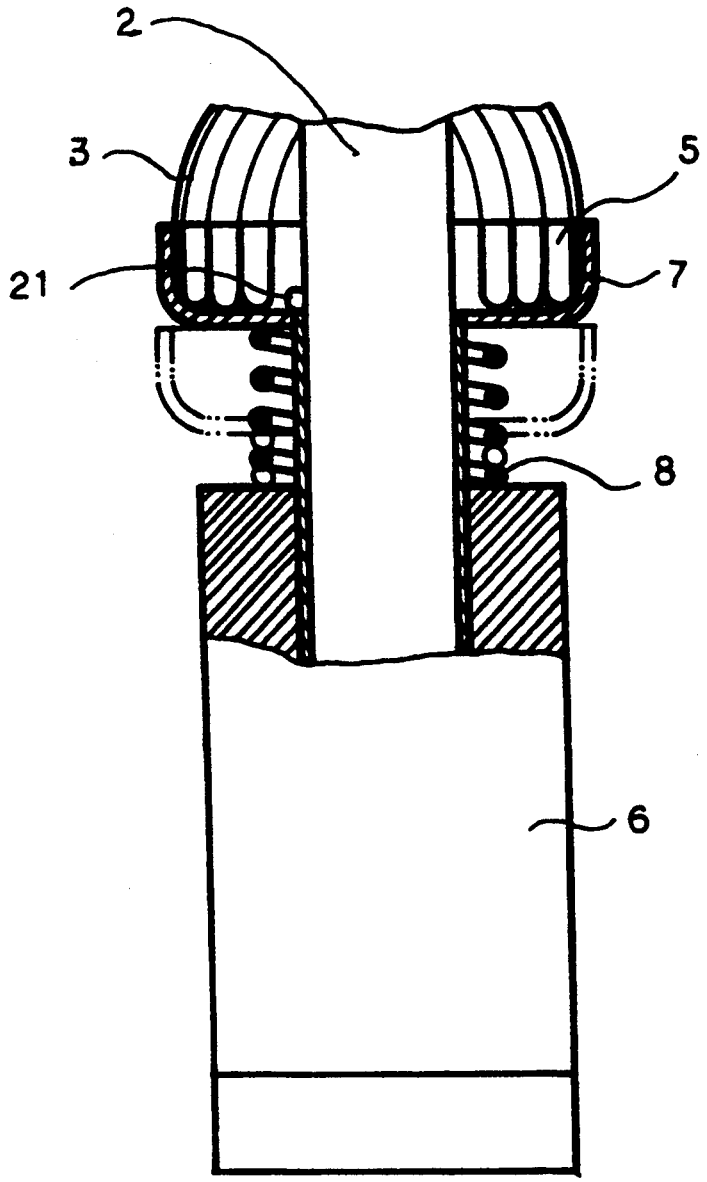
FIG. 3 PRIOR ART
FIG. 3 is a sectional view of an alternative embodiment of a prior structure.
Figure 4:
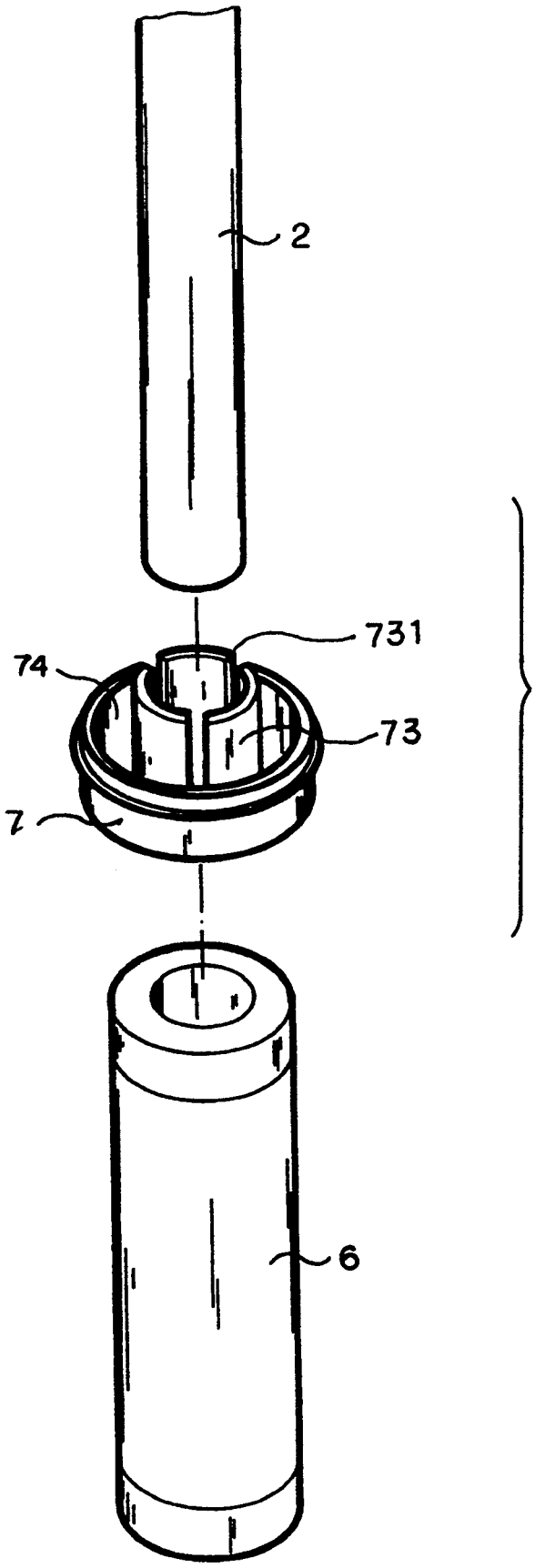
FIG. 4 is an exploded view of the structure of the present invention.
Figure 5:
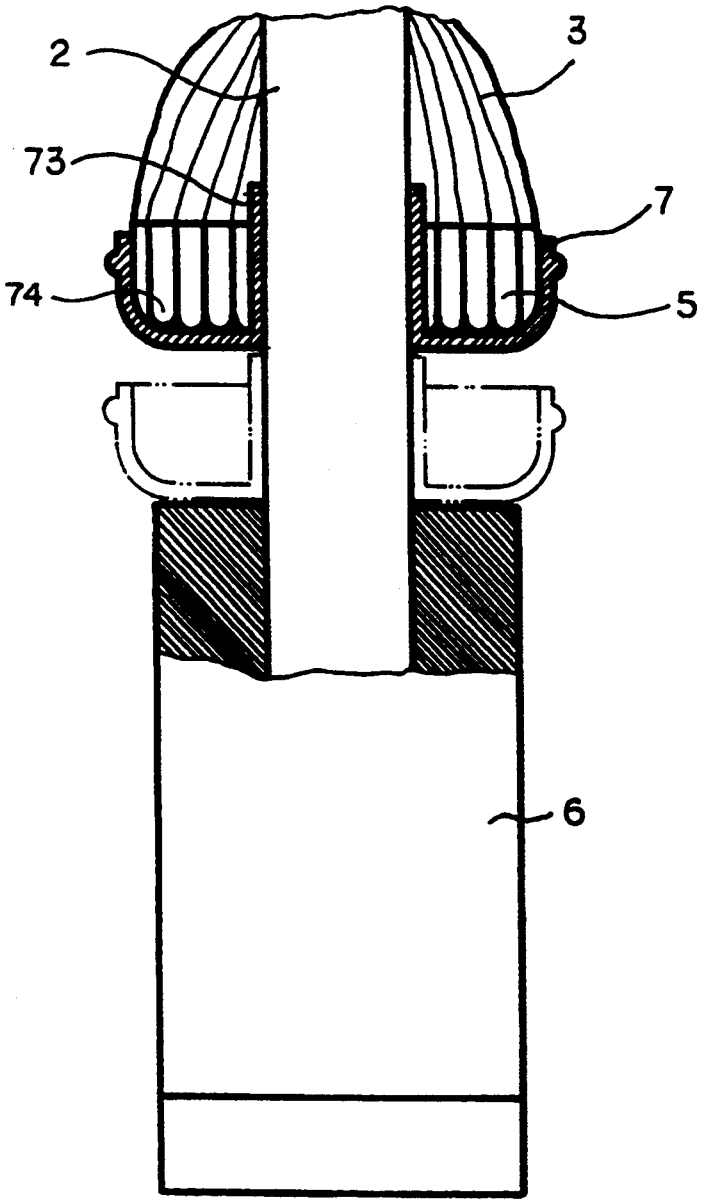
FIG. 5 is a sectional view of the structure of the present invention.

Referring to FIGS. 4 and 5, the umbrella ring of the present invention is used to position the tips 5 which connect every corner of the canopy 3 to the ribs 4 of an umbrella which can not be telescoped and which mainly consists of a shank 2, a canopy 3, ribs 4, tips 5 and a handle 6. The improved ring 7 of the present invention includes a sleeve 73 having slots 731 which are formed therein for positioning the tips 5 which connect said canopy 3 to said ribs 4 so that said umbrella ring can slide along said shank 2 to an appropriate position to placing said ribs 4 and said tips 5 completely in the inside space 74 of said umbrella ring 7 effectively and easily.

While only one embodiment of the present invention has been shown and described, it will be understood that various modifications and changes could be made without departing from the spirit and scope of the invention.

What is claimed is:

1. An umbrella ring used on an umbrella shank for rotating umbrella tips proximate said umbrella shank, said umbrella ring comprising:

a cup having an annular peripheral wall extending from a circular base; said circular base having a central aperture receiving said umbrella shank;

a sleeve situated within said cup and projecting from said circular base in coaxial alignment with said cup and said central aperture; said sleeve having a plurality of slots formed therein and defining a plurality of cantilever spring fingers extending along said umbrella shank; and whereby said cup is slidable from a first position in which said cup in normally retained in axial alignment with said shank by said spring fingers to a second position in which said cup is slid along said shank to facilitate placement of said umbrella tips into said cup or removal of said umbrella tips from said cup.

2. An umbrella ring in accordance with claim 1 wherein said umbrella ring is made of plastic.

3. An umbrella comprising a canopy, a shank, a plurality of ribs radially and pivotally mounted at an uppermost portion of said shank and supporting said canopy, and an umbrella ring for retaining tips of said ribs proximate said shank, said umbrella ring comprising:

a cup having an annular peripheral wall extending upwardly from a circular base; said circular base having a central aperture;

a sleeve situated within said cup and projecting upwardly from said circular base in coaxial alignment with said cup and said central aperture; said sleeve receiving said umbrella shank; said sleeve having a plurality of slots formed therein and defining a plurality of cantilever spring fingers extending along said umbrella shank; and whereby said cup is slidable from a first position in which said cup is normally retained in axial alignment with said shank by said spring fingers to a second position in which said cup is slid along said shank to facilitate placement of said umbrella tips into said cup or removal of said umbrella tips from said cup.

4. An umbrella comprising a canopy, a shank, a plurality of ribs radially and pivotally mounted at an uppermost portion of said shank and supporting said canopy, and a one-piece, integral umbrella ring for retaining tips of said ribs proximate said shank, said umbrella ring comprising:

a cup having an annular peripheral wall extending from a circular base; said circular base having a central aperture;

a sleeve projecting from said circular base and defining an inner wall of said cup; said sleeve coaxially aligned with said central aperture and receiving said umbrella shank; said sleeve having a plurality of slots formed therein and defining a plurality of cantilever spring fingers extending along said umbrella shank; and whereby said cup is slidable from a first position in which said cup is normally retained in axial alignment with said shank by said spring fingers to a second position in which said cup is slid along said shank to facilitate placement of said umbrella tips into said cup or removal of said umbrella tips from said cup.

* * * * *